US006517306B1

(12) United States Patent
Budny et al.

(10) Patent No.: US 6,517,306 B1
(45) Date of Patent: Feb. 11, 2003

(54) METHOD OF AND APPARATUS FOR EMPTYING CONTAINERS

(75) Inventors: Piotr Budny, Hamburg (DE); Michael Knabe, Geesthacht (DE)

(73) Assignee: Hauni Maschinenbau AG, Hamburg (DE)

( * ) Notice: Subject to any disclaimer, the term of this patent is extended or adjusted under 35 U.S.C. 154(b) by 23 days.

(21) Appl. No.: 09/662,898

(22) Filed: Sep. 15, 2000

(30) Foreign Application Priority Data

Sep. 24, 1999 (DE) ..... 199 45 808

(51) Int. Cl.[7] ..... B65B 21/02; B65B 69/00; B65G 65/04; B65G 65/34; B65G 37/00

(52) U.S. Cl. ..... 414/420; 414/421; 198/347.1

(58) Field of Search ..... 414/403, 414, 414/420, 421; 198/347.1, 403, 418

(56) References Cited

U.S. PATENT DOCUMENTS

| | | | | |
|---|---|---|---|---|
| 3,527,369 A | | 9/1970 | Bornfleth et al. | |
| 3,655,080 A | | 4/1972 | Gianese | |
| 3,777,911 A | | 12/1973 | Bornfleth | |
| 4,303,366 A | * | 12/1981 | Hinchcliffe et al. | 414/421 X |
| 4,403,908 A | | 9/1983 | Cartoceti | |
| 4,449,625 A | | 5/1984 | Grieben et al. | |
| 4,455,117 A | | 6/1984 | Cartoceti | |
| 4,564,329 A | | 1/1986 | Bantien | |
| 4,575,301 A | * | 3/1986 | Lodi et al. | 414/420 X |
| 4,688,980 A | * | 8/1987 | Kikuchi et al. | 414/420 X |
| 5,106,254 A | | 4/1992 | Tolasch et al. | |
| 5,472,078 A | | 12/1995 | Hoffman et al. | |

FOREIGN PATENT DOCUMENTS

| | | |
|---|---|---|
| DE | 1956729 C3 | 6/1970 |
| DE | 2020825 | 12/1970 |
| DE | 1939395 B2 | 2/1971 |
| DE | 3028982 C2 | 2/1981 |

* cited by examiner

*Primary Examiner*—Christopher P. Ellis
*Assistant Examiner*—Gene O. Crawford

(57) ABSTRACT

Successive individual filled trays or successive groups of filled trays for stacks of parallel cigarettes are transported by a carriage from a source at a first level to a higher second level, and their contents are dumped into the magazine of a packing machine. The thus emptied tray(s) is or are returned to the first level and is or are expelled from the carriage, at least indirectly and/or at least in part, by the next following filled tray(s). The expelled emptied tray(s) is or are lowered into a storage facility at a level beneath the first level. The carriage has open front and rear sides for admission of filled trays through the front side and for expulsion of emptied trays through the rear side.

74 Claims, 9 Drawing Sheets

METHOD OF AND APPARATUS FOR EMPTYING CONTAINERS

CROSS-REFERENCE TO RELATED CASES

This application claims the priority of commonly owned German patent application Serial No. 199 45 808.1 filed Sep. 24, 1999. The disclosure of the above-referenced German patent application, as well as that of each U.S. and foreign patent and patent application mentioned in the specification of the present application, is incorporated herein by reference.

BACKGROUND OF THE INVENTION

The present invention relates to improvements in methods of and in apparatus for emptying containers, and more particularly to improvements in methods of and in apparatus for manipulating refillable containers. Still more particularly, the invention relates to improvements in methods of and in apparatus for manipulating successive containers of a series of containers which must be transported from a source of filled containers to an evacuating or emptying sation and thereupon away from the emptying station, especially back to the source. Examples of containers which can be manipulated in accordance with the method and in the apparatus of the instant invention are so-called chargers or trays for piles or stacks of plain or filter cigarettes, cigars, cigarillos, filter rod sections and other rod-shaped articles of the tobacco processing industry.

It is customary to introduce the output of a cigarette making machine (or another machine for the making of rod-shaped products of the tobacco processing industry) into chargers or trays (hereinafter called trays) serving for temporary storage of the rod-shaped products (hereinafter referred to as cigarettes for short) as well as for the transport of cigarettes to a processing unit, e.g., to a packing machine. The contents of filled trays can be admitted directly into the magazine of a packing machine (e.g., a machine known as COMPAS 500 and distributed by the assignee of the present application) or into a reservoir which discharges a mass flow of parallel cigarettes into a packing machine. An apparatus for forming a mass flow of cigarettes or the like is disclosed, for example, in commonly owned U.S. Pat. No. 5,472,078 granted Dec. 5, 1995 to Hoffmann et al. for "METHOD OF AND APPARATUS FOR CONVERTING A SINGLE LAYER OF ROD-SHAPED ARTICLES INTO A MASS FLOW".

As a rule, a tray for temporary storage and/or transport of stacks of parallel cigarettes comprises a bottom wall, two upright sidewalls and a rear wall, i.e., the front side and the top of the tray are open. The axes of confined cigarettes are parallel to the sidewalls, and one of their ends abuts the rear wall. It is also possible to provide each tray with a top wall which is removable or retractible to permit convenient admission of cigarettes at the outlet of a cigarette maker, e.g., a machine known as PROTOS and designed to turn out plain cigarettes, or a machine known as MAX and designed to turn out filter cigarettes (such machines are distributed by the assignee of the present application).

It is customary to design the tray emptying or evacuating apparatus in such a way that successive filled trays are inverted upside down to thus discharge their contents into the magazine of a packing machine or into other suitable receiving means. Such inversion of filled trays is a feature of the combined tray-filling and tray-emptying apparatus known as COMFLEX (distributed by the assignee of the present application). Reference may also be had to U.S. Pat. No. 3,527,369 (granted Sep. 8, 1970 to Bornfleth et al. for "APPARATUS FOR FEEDING ROD-SHAPED ARTICLES TO CONSUMING MACHINES"), U.S. Pat. No. 3,655,080 (granted Apr. 11, 1972 to Gianese for "CIGARETTE PACKER HOPPER AUTOMATIC FEEDING DEVICE"), U.S. Pat. No. 3,777,911 (granted Dec. 11, 1973 to Bornfleth for "APPARATUS FOR MANIPULATING CONTAINERS FOR CIGARETTES OR THE LIKE"), and U.S. Pat. No. 4,403,908 (granted Sep. 13, 1983 to Cartoceti for "METHOD FOR THE EMPTYING OF CIGARETTE TRAYS INTO MAGAZINES"), as well as to German patent No. 19 39 395. As a rule, a so-called cage or carriage is used to receive a filled tray, to transport the filled tray to and to invert it at an emptying station, and to transport the emptied tray away from such station. The admission of a fresh filled tray into the carriage must be preceded by a time-consuming removal of the freshly emptied tray; such removal is efected by specially designed, bulky and expensive tray evacuating apparatus.

Commonly owned U.S. Pat. No. 4,564,329 (granted Jan. 14, 1986 to Bantien for "APPARATUS FOR MANIPULATING EMPTY AND FILLED TRAYS FOR CIGARETTES OR THE LIKE BETWEEN MAKING AND PROCESSING MACHINES") is designed to directly couple a cigarette maker with a packing machine.

Commonly owned U.S. Pat. No. 4,449,625 (granted May 22, 1984 to Grieben et al. for "APPARATUS FOR TRANSPORTING TRAYS FOR CIGARETTES OR THE LIKE") discloses an apparatus which transports freshly filled trays from a lower level of a tray filling machine to an upper level, namely to a tray removing station.

Commonly owned U.S. Pat. No. 5,106,254 (granted Apr. 21, 1992 to Tolasch et al. for "APPARATUS FOR FILLING AND EMPTYING TRAYS FOR ROD-SHAPED ARTICLES OF THE TOBACCO PROCESSING INDUSTRY") discloses an apparatus for removing cigarettes from a mass flow between one or more producing machines and one or more processing machines when the output of the producing machines exceeds the requirements of the processing machines, and for returning cigarettes into the mass flow when the requirements of the processing machines exceed the output of the producing machines.

OBJECTS OF THE INVENTION

An important object of the present invention is to provide a novel and improved method of manipulating filled and emptied containers for accumulations (such as so-called quincunx formations) of discrete commodities, for example, arrays of rod-shaped articles of the tobacco processing industry.

Another object of the invention is to provide a method which can be resorted to for replacement, in a mobile carriage, of fully emptied containers with filled containers in a simple, inexpensive and time-saving manner.

A further object of the invention is to provide a method which renders it possible to remove emptied containers from a mobile carriage simultaneously with the carrying out of a different step involving the manipulation of the carriage and/or its contents.

An additional object of the invention is to provide a novel series of steps which can be carried out in connection with the evacuation of the contents of chargers or trays for cigarettes or other rod-shaped products of the tobacco processing industry.

Still another object of the invention is to provide a method which can be practiced by resorting to novel machines, apparatus or production lines and/or by resorting to certain existing apparatus, machines or production lines which necessitate relatively minor adaptations to render them suitable for the practice of the present invention.

A further important object of the present invention is to provide a novel and improved apparatus for the practice of the above outlined method.

Another object of the invention is to provide the apparatus with novel and improved means for expelling freshly emptied containers for cigarettes or the like from a carriage for filled and emptied containers.

An additional object of the invention is to provide the apparatus with novel and improved means for the transport and temporary storage of emptied containers upon expulsion of such containers from their carriage.

Still another object of the invention is to provide a novel and improved arrangement for introducing filled containers into a mobile carriage for filled and emptied containers.

A further object of the invention is to provide novel and improved means for temporarily coupling a container to a carriage in the above outlined apparatus.

Another object of the invention is to provide an apparatus which can be utilized as a space-saving substitute for conventional apparatus in production lines which turn out packaged rod-shaped articles of the tobacco processing industry.

An additional object of the invention is to provide a novel and improved link between one or more cigarette makers and one or more cigarette packers and/or other cigarette processing machines or units.

Still another object of the invention is to provide a novel and improved arrangement for manipulating emptied containers prior to, during and subsequent to their expulsion from the carriage.

A further object of the invention is to provide the apparatus with novel and improved means for introducing filled containers into the carriage and for simultaneously carrying out at least one additional useful and important operation.

SUMMARY OF THE INVENTION

One feature of the present invention resides in the provision of a method of manipulating successive filled and emptied containers by a mobile carriage between a source of filled containers and an emptying station. The improved method comprises the steps of conveying the carriage with an emptied container therein from the emptying station to the source, advancing a filled container from the source into the carriage to thus at least indirectly and at least partially expel the emptied container from the carriage, transporting the carriage and the filled container therein from the source to the emptying station, evacuating the contents of the filled container in the carriage at the emptying station to thus convert the filled container into an emptied container, and repeating the above-enumerated conveying, advancing, transporting and evacuating steps as long and as often as necessary to satisfy the requirements (of the machine or machines which receives or receive commodities being evacuated from successive filled containers at the emptying station.

The conveying step preferably includes moving the carriage with an emptied container therein from the emptying station, along a predetermined path, and to the source; the transporting step of such method can include moving the carriage and the filled container in the carriage from the source, along the aforementioned predetermined path, and to the emptying station.

The advancing step can include moving a filled container from the source, along an at least substantially horizontal path and into the carriage to thus directly and fully expel the emptied container from the carriage. The advancing step can further include expelling the emptied container into an additional path having a receiving portion which constitutes an extension of the at least substantially horizontal path.

The method can further comprise the step of releasably securing the container which is located in the carriage to the carriage in the course of at least one of the conveying, transporting and evacuating steps.

The transporting step of the aforedescribed method can include moving the carriage and the filled container therein from the source to the emptying station along an at least partially arcuate path, e.g., along an at least substantially semicircular path. If such method is resorted to for manipulation of successive filled and emptied containers for flowable commodities (such as arrays of parallel cigarettes), it can further comprise the step of maintaining a descending supply of commodities at the emptying station (e.g., in the magazine of a cigarette packing machine), and the evacuating step of such method can include lowering the filled container (e.g., with the carriage) at the emptying station toward the descending supply of commodities and thereupon releasing the commodities for gravitational descent from the filled container onto the descending supply of commodities. The conveying step of such method can include raising the carriage and the emptied container therein above and away from the descending supply of commodities at the emptying station and thereupon moving the carriage and the emptied container in the carriage from the emptying station to the source. The transporting step of the just described embodiment of the method can further include inverting the carriage and the filled container in the carriage upside down so that the commodities in the filled container come to rest on a retractible or removable cover of the carriage at the emptying station; the releasing step can include retracting the cover of the carriage. Such method can further comprise the steps of monitoring the position of the carriage at the emptying station, generating signals denoting the position of the carriage at the emptying station, and utilizing such signals to initiate retraction of the cover in a predetermined position of the carriage relative to the emptying station.

The method can further comprise the step of lowering the expelled emptied container to a level beneath the source of filled containers. Such method can further comprise the step of moving the lowered emptied container along an at least substantially horizontal path.

The advancing step can include moving a filled container from the source into the carriage to an extent which is necessary to expel the entire emptied container from the carriage. Such advancing step can further include positively driving a filled container from the source into the carriage. Still further, such advancing step can include tilting the carriage not later than upon completion of the conveying step.

In accordance with a presently preferred embodiment of the improved method, the advancing step can include utilizing the filled container to fully expel the emptied container from the carriage.

The containers can constitute so-called chargers or trays which serve for temporary storage and transport of rod-shaped articles of the tobacco processing industry. Such method can further comprise the steps of filling a succession of empty trays (such as emptied trays returned from the emptying station) with rod-shaped articles and delivering the thus filled trays to the source. The evacuating step of such method can include admitting rod-shaped articles from the filled container at the emptying station into a packing machine for rod-shaped articles of the tobacco processing industry.

The transporting step of the improved method can include turning the carriage and the filled container in such carriage upside down during transport from the source of filled containers to the emptying station. The evacuating step of such method can include emptying the filled container at the emptying station by gravity flow of its contents into a magazine, such as the magazine of a packing machine or a receptacle for temporary storage of commodities ahead of a packing machine.

Another feature of the invention resides in the provision of an apparatus for manipulating successive filled and emptied containers. The improved apparatus comprises a source of filled containers, and an emptying unit including means for receiving the contents of filled containers, a carriage for filled and emptied containers, and transporting means for moving the carriage with at least one filled container therein from a first location at the source to a second location at the receiving means and for moving the carriage with at least one emptied container from the second location back to the first location. The apparatus further comprises means for introducing filled containers from the source into the carriage at the first location to an extent such that the emptied at least one container is at least indirectly and at least partially expelled from the carriage as a result of introduction of at least one filled container into the carriage.

The transporting means can include means for moving the carriage and its contents (i.e., at least one filled container or at least one emptied container) back and forth along an at least partially arcuate (such as a substantially semicircular) path having a first end at the source of filled trays and a second end at the receiving means.

The introducing means of the improved apparatus can comprise a transfer unit having means for advancing filled containers from the source into the carriage while the latter dwells at the first location. The advancing means of such introducing means can include means for moving filled containers along an at least partially horizontal path or along an at least substantially horizontal path. For example, the advancing means can include at least one linear actuator, e.g., an actuator which employs a piston rod-free fluid-operated (e.g., pneumatically operated) motor. Still further, such actuating means can comprise a vehicle for filled containers and means for moving the vehicle (with at least one filled container therein) from the source to the carriage at the first location. The vehicle can constitute a means for directly contacting and at least partially expelling emptied containers from the carriage at the first location. The vehicle can be provided with a substantially upright wall and the advancing means can further comprise means for tilting the vehicle so that a filled receptacle in the tilted vehicle abuts the wall under the action of gravity. The apparatus exhibiting the just discussed features can be further provided with means for actuating the tilting means during a predetermined stage of dwell of the carriage at the first location.

The apparatus further comprises means for releasably securing containers to the carriage while the carriage is away from the first location. The securing means can include means for temporarily locking containers to the carriage during movement of the carriage between a first level of the first location and a different second level of the second location. The provision of suitable securing means is important if the carriage and its contents are turned upside down during movement of the carriage from the first location to the second location, i.e., from the source of filled containers toward the receiving means.

The carriage can be provided with a cover which is movable between an operative position in which it overlies a filled container in the carriage and an inoperative position in which it is offset from a filled container in the carriage (the cover can be separably or shiftably, pivotably or otherwise connected to the carriage). If the transporting means includes means for turning the carriage and at least one filled container therein upside down during movement of the carriage from the first location to the second location, such manipulation of the carriage causes the contents of a filled container in the carriage to come to rest on the cover while the cover dwells in the operative position and the carriage is disposed at the second location. The emptying unit can comprise means for moving the cover to the inoperative position upon arrival of the carriage and at least one filled container therein at the second location. The receiving means can include at least one wall which is movable between a raised and a lowered position, and the receiving means can comprise a magazine (such as the magazine of a packing machine) for the contents of emptied containers. The magazine has an open top and the at least one wall is adjacent such open top. The arrangement is preferably such that the carriage comes to rest upon the raised wall of the receiving means when the carriage arrives at the second location. Such apparatus can further comprise means for lowering the at least one Wall, with the carriage on the wall, and means for setting the lowering means in motion until the cover descends to a level at which it is located at a predetermined distance from and above the contents of the magazine. The means for moving the cover is or can be arranged to move the cover to the operative position upon completed lowering of the at least one wall to the aforementioned level at which the cover is located at the predetermined distance from and above the contents of the magazine.

The improved apparatus is preferably further provided with means for inercepting emptied containers upon expulsion from the carriage. Such intercepting means can comprise means for lowering emptied containers from a first level of the first location to a second level below the first location.

The apparatus can also comprise a storage facility for emptied containers which are supplied by the just mentioned lowering means; such storage facility can comprise an at least substantially horizontal conveyor for emptied containers.

The source can comprise, or it can be associated with, means for filling emptied containers with a flowable array of commodities, for example, with rod-shaped articles of the tobacco processing industry. The receiving means of such apparatus can be associated with a machine (such as the aforediscussed cigarette packing machine) for processing rod-shaped articles of the tobacco processing industry.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
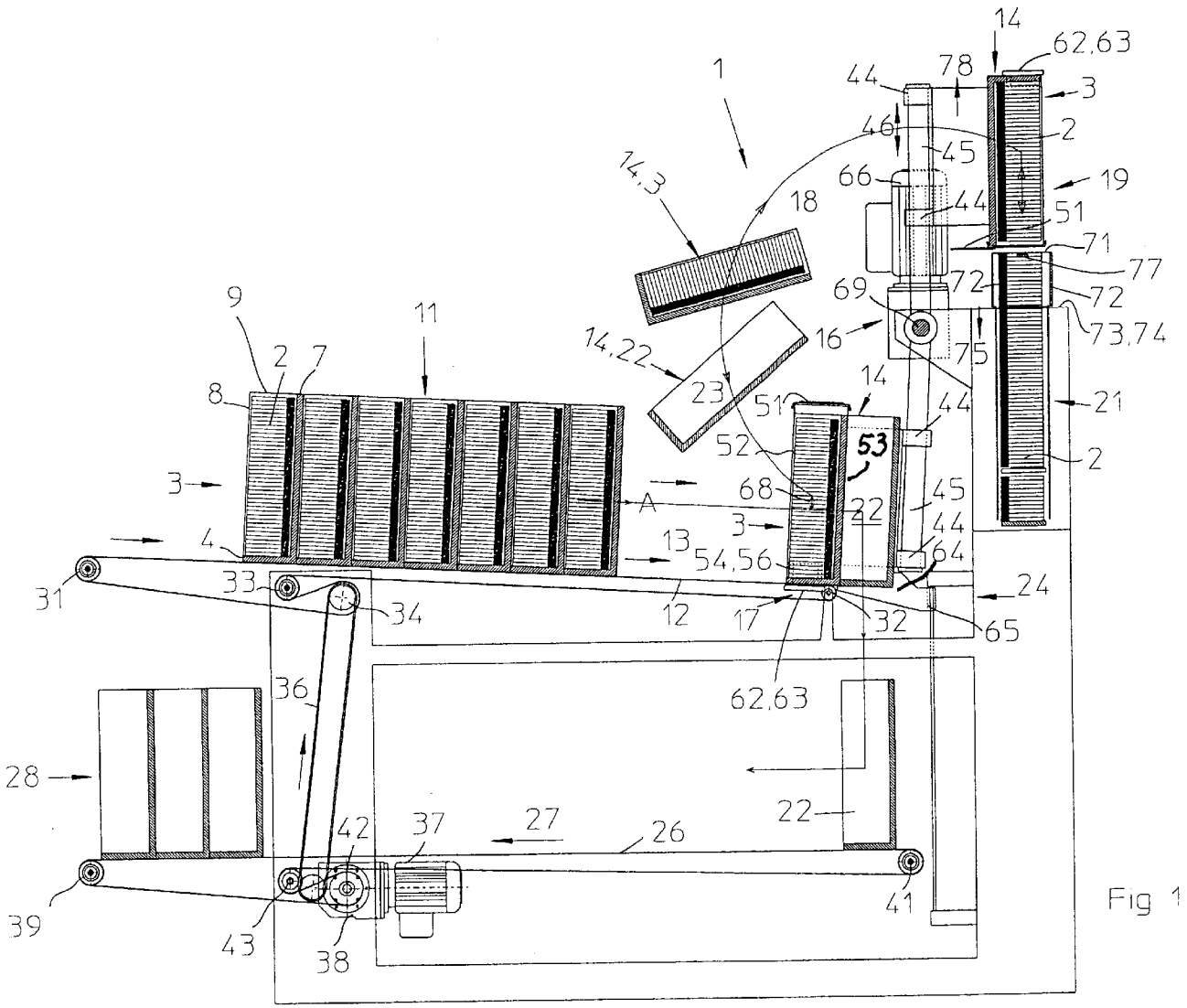
FIG. 1 is a somewhat schematic partly front elevational and partly vertical sectional view of an apparatus which embodies one form of the present invention, the carriage being shown in three different positions including a position at the level of the source of filled containers, while already confining a filled container and adjacent to a freshly expelled emptied container.

FIG. 1 shows an apparatus 1 which is designed to manipulate containers of the type known as chargers or trays and serving for temporary storage and transport of arrays of parallel rod-shaped articles 2 of the tobacco processing industry. For example, the articles 2 can constitute plain cigarettes turned out by a GARANT machine or filter cigarettes produced by a MAX machine. As a rule, the articles 2 (hereinafter called cigarettes) are accumulated in a so-called quincunx formation and are confined in a filled container 3 (hereinafter called tray for short) in such a way that the axes of the confined cigarettes are parallel to the planes of two spaced-apart upright sidewalls 6 and normal to the upright rear wall 7 of a tray. The lower ends of the sidewalls 6 are rigid with a horizontal bottom wall 4 of the tray. Thus, each of the trays which are shown in the drawings has an open front side 8 and an open top side 9. This is the customary design of many trays which are presently employed to transport batches of cigarettes from a source 11 of filled trays 3 to an emptying station 19 where the contents of filled trays 3 are dumped into a receiving means 21. The illustrated receiving means 21 is the magazine or hopper of a processing machine, such as the aforementioned COMPAS 500 packing machine. The thus obtained emptied trays 22 are conveyed from the emptying station 19 back to the source 11. The aforementioned COMFLEX machine embodies means which can be utilized to introduce cigarettes from a maker into successive emptied trays 22 or into analogous containers for rod-shaped smokers' products (such products include plain or filter cigarettes, cigars, cigarillos, filter rod sections and others).

The source 11 receives filled trays 3 subsequent to a shorter- or longer-lasting storage, or for such storage, prior to delivery to the emptying station 19.

Figure 2A:
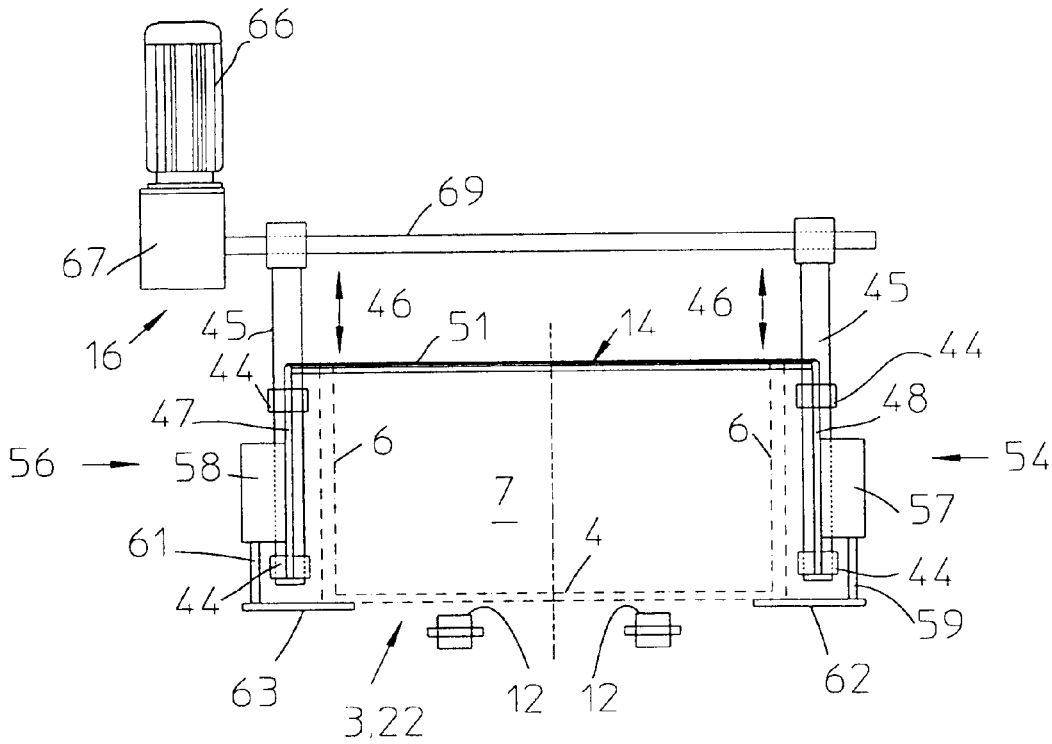
FIG. 2*a* is a front elevational view of the carriage, of a container therein, and of certain other component parts of the apparatus substantially as seen in the direction of arrow A in FIG. 1, the container being releasably secured to the carriage.
Figure 2B:
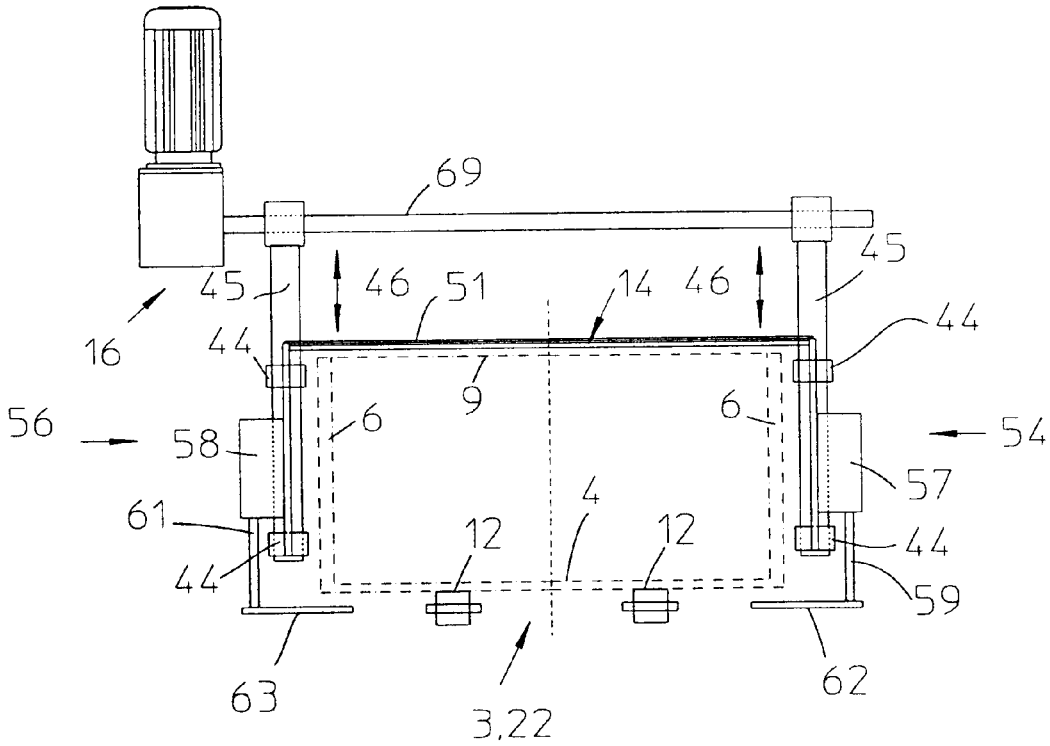
FIG. 2*b* illustrates the structure of FIG. 2*a* but with the container free to move relative to the carriage.

The advancing means which, in accordance with a feature of the present invention, serves to advance successive filled trays 3 from the source 11 into a carriage or cage 14 (at a first location 17 which is disposed at the level of the source 11) includes a composite conveyor 12 employing two endless belts (see FIGS. 2*a* and 2*b*) having coplanar horizontal (or at least partly or substantially horizontal) upper reaches adapted to support (if necessary) a large or reasonably large supply of filled trays 3 at a locus ahead or upstream of the location 17 (as seen in the direction indicated by an arrow 13).

The carriage 14 is being transported, between the first location 17 and a second location at a level above the location 17 and above the magazine 21, by a conveying or transporting unit 16 which is set up to move the carriage and its contents along an arcuate path (such as a substantially semicircular path). The direction of movement of the carriage 14 (with at least one filled tray 3 therein) from the first location 17 to the emptying or evacuating station 19 is indicated by an arrow 18, and the direction of movement of the carriage 14 (with at least one freshly emptied tray 22 therein) along the same arcuate path back to the location 17 is indicated by an arrow 23.

The extent of movement of the foremost filled tray 3 from the source 11, in the direction of the arrow 13, and on to the location 17 is such that it suffices to at least partially expel the emptied tray 22 from the carriage 14 onto or into an elevator 24 which serves as means or unit for lowering successive emptied trays from the level of the location 17 to a lower level, namely onto a belt or chain conveyor 26 which can be started to advance successive empty trays 22 along a preferably horizontal or nearly horizontal path (see the arrow 27) to a suitable storage facility 28. The conveyor 26 can comprise two endless belts or chains disposed in parallel vertical planes.

Referring to the aforementioned constituents and to other parts of the apparatus 1 in greater detail, FIG. 1 shows that the belts of the conveyor 12 forming part of the means for introducing filled trays 3 into the carriage 14 are trained over pulleys 31, 32, 33 and 34. The latter is driven (when necessary) by a toothed belt 36 which receives motion from a variable-speed and/or otherwise adjustable electric motor 37 by way of a transmission 38. This transmission further transmits motion to the pulley 42 of a set of pulleys 39, 41, 42, 43 for the endless belts of the preferably horizontal conveyor 26 which advances successive emptied trays 22 from the lowering unit 24, in the direction of the arrow 27, and into the storage facility 28. The latter can be used as a depository for emptied trays 22 which are to be transported to the aforementioned tray filling machine (such as COMFLEX).

The carriage 14 comprises two upright sidewalls 47, 48 (see FIG. 2*a*) and a cover or lid 51 which is movable (e.g., slidable) between an operative position (see, for example, FIG. 1) and an inoperative position (see the top part of FIG. 1). The cover 51 assumes the inoperative position when the filled tray 3 at the station 19 is ready to dump its contents into the magazine 21. Suitable drive means is provided to move the cover 51 between its operative and inoperative positions in response to a signal denoting that the carriage 14 (with an inverted filled tray 3 therein) is in an optimum position for the dumping of the contents of such tray into the magazine 21. The exact details of the means for moving the cover 51 between its operative and inoperative positions forms no part of the present invention; reference may be had to the aforementioned U.S. Pat. Nos. 3,527,369, 3,655,080, 3,777,911 and 4,403,908.

The carriage 14 is devoid of a front wall and of a rear wall, i.e. , the front side 52 and the rear side 53 of the carriage are open. This renders it possible to introduce a filled tray 3 into the carriage 14 through the open front side 52 (while the carriage is held at the location 17) and to utilize such filled tray to simultaneously expel an emptied tray 22 through the rear side 53 and onto the lowering means or unit 24 which, at such time, maintains its tray-receiving or intercepting member 64 at the level of the upper reaches of the belts forming part of the conveyor 12 so that the level of the emptied tray 22 need not be changed during expulsion (directly by the oncoming filled tray 3) from the carriage 14. The manner in which all filled trays 3 with the exception of the foremost filled tray in the source 11 are held against movement with the foremost filled tray toward the location 17 is not shown in FIG. 1.

The transporting or conveying unit 16 includes two spaced-apart parallel arms 45 which are pivotable about the axis of a horizontal shaft 69 and serve to guide annular followers 44 provided on the sidewalls 47, 48 of the carriage 14. A drive (not shown) is provided to move (when necessary) the followers 44 of the sidewalls 47, 48 longitudinally of the respective arms 45 (see the double-headed arrow 46 shown in the upper portion of FIG. 1).

The carriage 14 is provided with means for releasably securing thereto at least one filled tray 3 on its way from the first location 17 at the source 11 to the second location at the emptying station 19, and at least one emptied tray 22 from the station 19 back to the location 17. The illustrated securing means comprises two clamping or coupling or locking devices 54 and 56 which respectively include fluid-operated (such as pneumatic) cylinders 57 and 58, piston rods 59 and 61, and plate-like tray-engaging members 62 and 63 mounted on the respective piston rods 59 and 61 (see particularly FIGS. 2*a* and 2*b*). When the cylinders 57, 58 are actuated in response to transmission of a suitable signal (such as an electric signal), they cause their piston rods 59, 61 to respectively raise the engaging members 62, 63 from the lowered positions of FIG. 2*b* to the raised positions of FIG. 2*a*. The relatively short distance through which the members 62, 63 can lift a filled tray 3 in the carriage 14 is shown in FIG. 1, as at 68; this suffices to lift the filled tray 3 and to urge its walls 6, 7, 6 against the underside of the cover 51. Such engagement between a filled tray 3 and the carriage 14 suffices to ensure that the position of the filled tray relative to the carriage remains unchanged during pivoting of the carriage by the unit 16; when such pivoting movement from the location 17 to the emptying station 19 is completed, the supply of cigarettes 2 in the inverted filled tray 3 comes to rest on the cover 51. The coupling devices 54, 56 remain or become effective while the carriage 14 pivots a freshly emptied tray 22 from the station 19 back to the location 17. Once the carriage 14 has completed its return movement to the location 17, the cylinders 57, 58 are actuated to lower the respective piston rods 59, 61 and the corresponding engaging members 62, 63 (through the distance 68) so that the emptied tray 22 can be expelled from the carriage by the oncoming filled tray or trays 3.

The carriage 14 can be designed to accommodate two or more filled trays 3 or emptied trays 22, e.g., two or more trays behind each other as seen in the direction of the arrow 13. It is clear that the coupling devices 54, 56 are then modified (e.g., their members 62, 63 can be enlarged) accordingly. It is also possible to employ purely mechanical or electromagnetic or other suitable securing means in lieu of or in addition to the coupling devices 54, 56.

Figure 11:
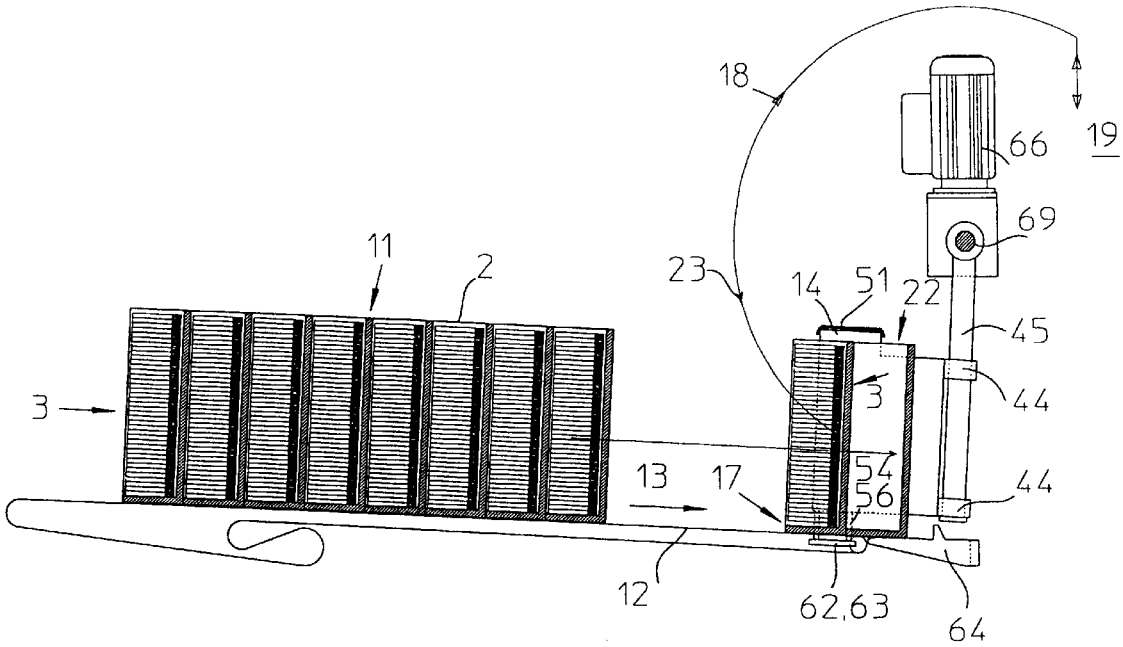

FIG. 11 shows a filled tray 3 halfway in the carriage 14 at the location 17, and an emptied tray 22 halfway in and halfway outside of the carriage. The partially expelled empty tray 22 rests on the mobile supporting or intercepting member 64 of the lowering unit 24; this member 64 initially maintains the partly and thereafter fully expelled emptied tray 22 at the level of the filled trays 3 on the conveyor 12. FIG. 1 shows a feed screw drive 65 which forms part of the lowering unit 24 and is designed to lower an emptied tray 22 from the level of the location 17 to the level of the upper reach of the conveyor 26. This feed screw drive 65 can be activated and/or deactivated in response to suitable signals (e.g., electric signals). In lieu of the feed screw drive 65, the lowering unit 24 for emptied trays 22 can employ one or more motor-driven toothed endless belts or the like. All that counts is to ensure that an emptied tray 22 can be lowered toward or onto the conveyor 26 in good time to enable the intercepting member 64 to accept the next-following emptied tray 22 when the carriage 14 returns to the level of the location 17.

Arrangements for raising and/or lowering filled and/or emptied trays (3, 22) are well known in the tobacco processing field. Reference may be had again to the aforementioned publications such as the U.S. Pat. Nos. 3,527,369, 3,655,080 and 3,777,911.

The transporting unit 16 comprises the aforementioned carriage 14, the arms 45 and the followers 44, as well as a prime mover 66 (such as a reversible electric motor) and a transmission 67 driven by the prime mover 66 and serving to turn the shaft 69 back and forth (in directions indicated by the arrows 18, 23) to thus move the carriage 14 between the first location 17 and the second location (also shown in FIG. 1) at the emptying station 19. Transporting units of the character or similar to that shown at 16 are known in the relevant art; they can respond to electric or other suitable signals to initiate the movements of the driven part (i.e., of the carriage 14 and its contents) between two spaced-apart positions. Reference may be had again to the aforementioned U.S. patents. Such units are also called dumping, tilting or inverting devices.

When the carriage 14 (with one or more filled trays 3 therein) reaches the second location above the emptying or dumping station 19, it comes to rest upon the upper marginal portions 71 of walls 72 which are movable up and down, for example, in a manner as disclosed in U.S. Pat. No. 3,527,369 and in German patent No. 19 39 395. The walls 72 form part of the magazine 21 and flank a space for the reception and temporary storage of a supply of parallel cigarettes 2. FIG. 1 shows the walls 72 in their upper end positions in which the lower end portions 73 of these walls are flush with or close to the upper end of the stationary portion 74 (e.g., a duct) of the magazine 21. The supply of cigarettes 2 in the magazine 21 constitutes the batch or batches delivered during the preceding dumping of the contents of one or more filled trays 3.

The level of the top layer of the supply of cigarettes 2 in the magazine 21 descends gradually or stepwise at a rate commensurate with the output of the processing (such as packing) machine which comprises or cooperates with the magazine. As a rule, a fresh batch of cigarettes 2 (namely the contents of the filled tray(s) having been confined in the carriage 141 are dumped into the magazine 21 before the level of the supply of cigarettes in the magazine descends to that of the upper end of the stationary portion 74. In other words, the carriage 14 dumps or is ready to dump the contents of one or more filled trays 3 while the space between the at least partially raised walls 72 still contains a stack or pile consisting of superimposed layers of cigarettes 2.

Once the carriage 14 comes to rest on the upper marginal portions 71 of the walls 72, these walls are caused to descend (note the arrow 75 in FIG. 1) by a drive corresponding, for example, to that disclosed in U.S. Pat. No. 3,527,369. In other words, the mobile walls 72 move downwardly relative to the walls of the stationary portion 74 of the magazine 21. The means for raising and lowering the walls 72 can include one or more fluid-operated (e.g., pneumatic) cylinder and piston units or one or more electric motors or the like. The arms 45 of the transporting unit 16 cooperate with the followers 44 to ensure that the carriage 14 and its contents (one or more filled trays 3) descend along a predetermined path. When the upper marginal portions 71 of the mobile walls 72 descend to the (predetermined) level of the top layer of the supply of cigarettes 2 in the magazine 21, a photoelectric cell or another suitable monitoring device generates a signal which causes the carriage 14 to terminate its downward movement along the arms 45 of the transporting unit 16. The monitoring device 77 can be affixed to one of the marginal portions 71 so that it shares the downward movement of the carriage 14 along the arms 45.

The signal from the monitoring device 77 can be utilized to start the mechanism which moves the cover 51 from its operative position to the retracted or inoperative position (shown in the upper part of FIG. 1) so that the contents of the filled tray(s) 3 in the (then inverted) carriage 14 can descend into the magazine 21. The distance which is covered by the cigarettes 2 descending from the interior of the carriage 14 into the magazine 21 is relatively or very short due to the aforedescribed feature that the inverted carriage can descend along the arms 45 of the transporting unit 16 when the carriage reaches the inverted position shown in the upper part of FIG. 1.

The next stage of the tray emptying operation involves the starting of the drive for the carriage 14 in reverse so that the followers 44 of the carriage travel along the respective arms 45 upwardly (see the arrow 78 in FIG. 1) and away from the magazine 21. The evacuation of the contents of the filled tray(s) 3 at the emptying station 19 continues (or can continue) while the carriage 14 moves upwardly in the direction of the arrow 78, and such movement is shared by the monitoring device 77. The latter generates a signal when the emptying step is completed, and such signal causes the prime mover 66 to start the return movement of the carriage 14 in the direction of the arrow 23, i.e., back toward the location 17. The drive for the cover 51 is caused or can be caused to return the cover to its operative position not later than when the carriage 14 reaches the location 17. The next step involves a deactivation or disengagement of the securing devices 54, 56 so that the emptied tray(s) 22 is or are free to move relative to the carriage in response to introduction of one or more filled trays 3 which is or are caused to move in the direction of the arrow 13 in a manner and for the purposes as already described hereinbefore. Disengagement of the securing devices 54, 56 and the admission of one or more filled trays 3 into the carriage 14 initiate a transfer of the thus released empty tray or trays 22 onto the member 64 preparatory to lowering by the unit 24 onto the conveyor 26 and transport to the storage facility 28. This completes that cycle which begins with the movement of the freshly filled carriage 14 from the location 17 to the station 19, lowering along the arms 45 of the transporting unit 16, raising along such arms, and return movement to the location 17.

FIGS. 3 through 12 illustrate various stages of operation of the apparatus 1, i.e., various steps of that embodiment of the improved method which can be practiced by resorting to the apparatus 1. If the step of conveying the carriage 14 (with at least one emptied tray 22 therein) from the emptying station 19 to the location 17 is considered as the first step of such method, the next-following steps include advancing at least one filled tray 3 from the source 11 into the carriage at the location 17 to this directly and fully expel the emptied tray(s) 22 from the carriage, transporting (by the unit 16) the carriage and the filled tray(s) from the location 17 to the emptying station 19, evacuating the contents (cigarettes 2) of the filled tray(s) in the carriage at the station 19 to thus convert the filled tray(s) into one or more empty trays 22, and repeating the conveying, advancing, transporting and evacuating steps as long and as often as is necessary to satisfy the requirements of the processing machine(s) which includes or include (or receive cigarettes 2 from) the magazine 21.

Figure 3:
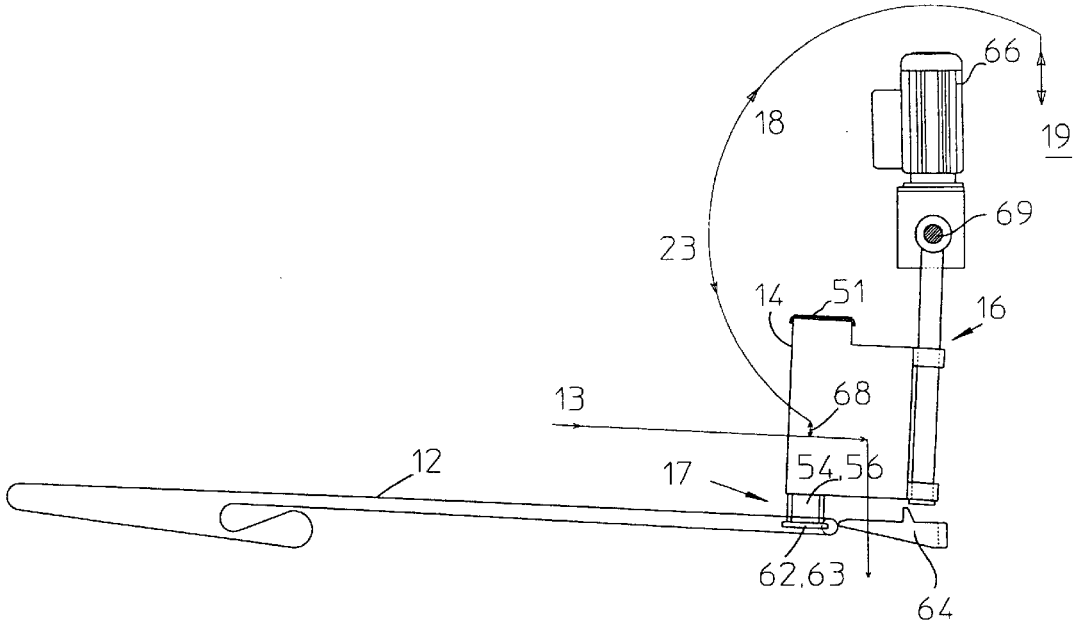
FIG. 3 is a side elevational view of the carriage at the level of the source of filled containers and of the mechanism for transporting or conveying the carriage between the source and the magazine of a processing machine.

FIG. 3 shows certain constituents of the apparatus 1 with the filled and emptied trays 3, 22 omitted. The carriage 14 is shown in a position at the location 17.

Figure 4:
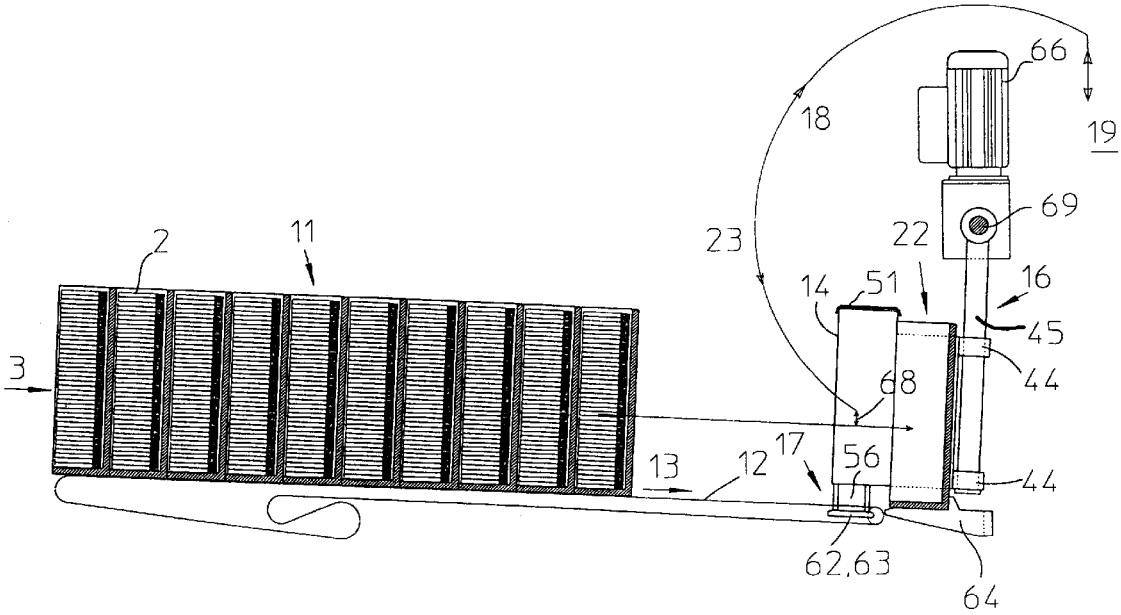
FIGS. 4 through 12 are side elevational views of the source, of the magazine and of the carriage during different stages of back-and-forth movements of the carriage between the level of the source and the level above the magazine.

FIG. 4 shows a series of filled trays 3 at the source 11, and an emptied and freshly expelled tray 22 next to the carriage 14 at the location 17.

Figure 5:
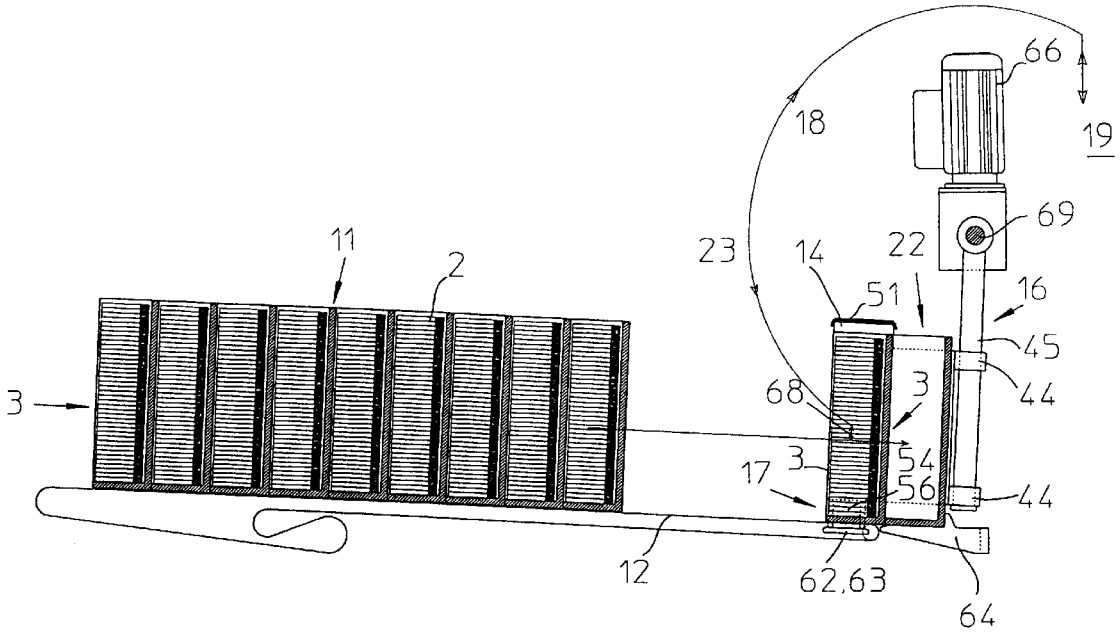
Figure 6:
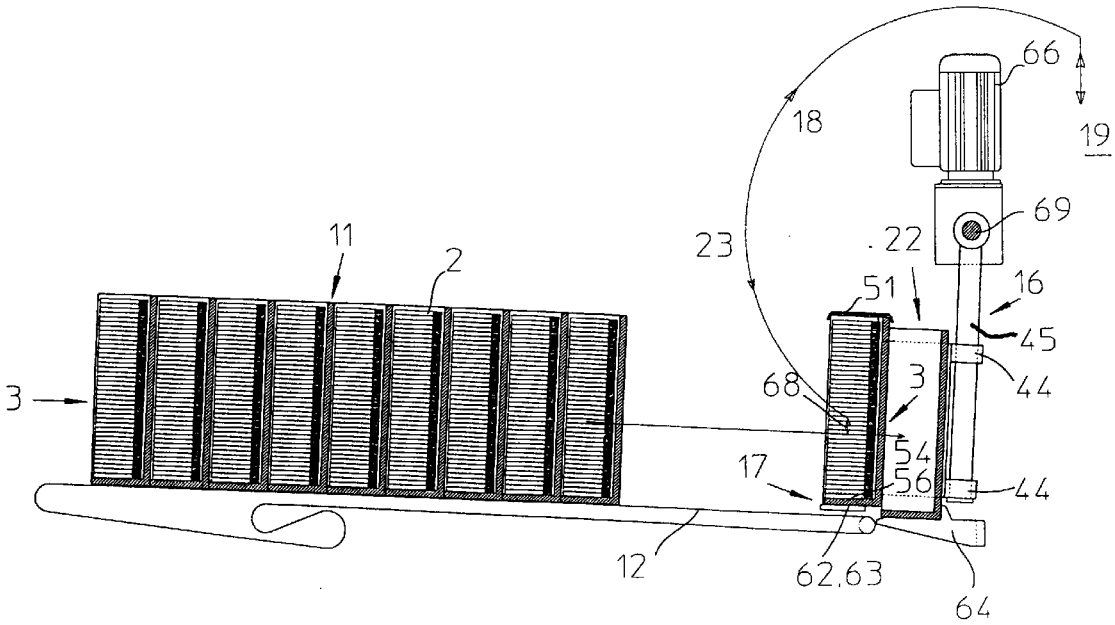

FIG. 5 shows the structure of FIG. 4 but with the carriage 14 and the filled tray 3 therein in a vertical sectional view. The securing devices 54, 56 are idle, i.e., the filled tray in the carriage must be secured to the latter before the carriage is pivoted from the location 17 toward the emptying station 19. The operative positions of the securing devices 54, 56 are shown in FIG. 6, i.e., the filled tray 3 bears upon the cover 51 which is shown in the operative position.

Figure 7:
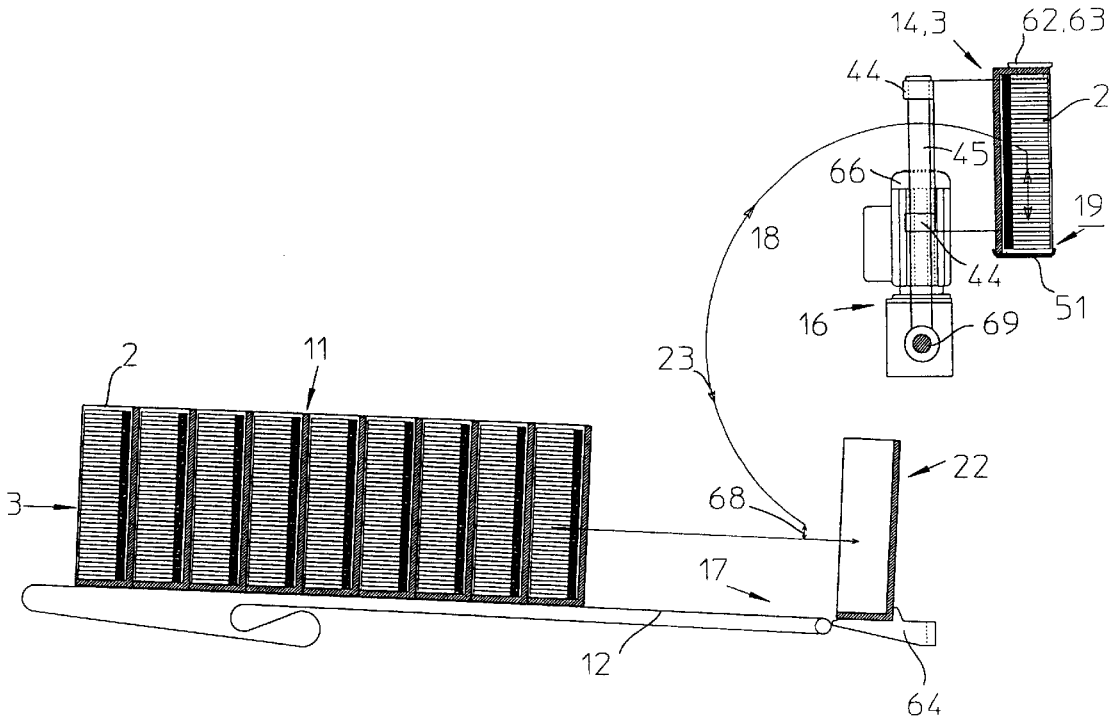
Figure 8:
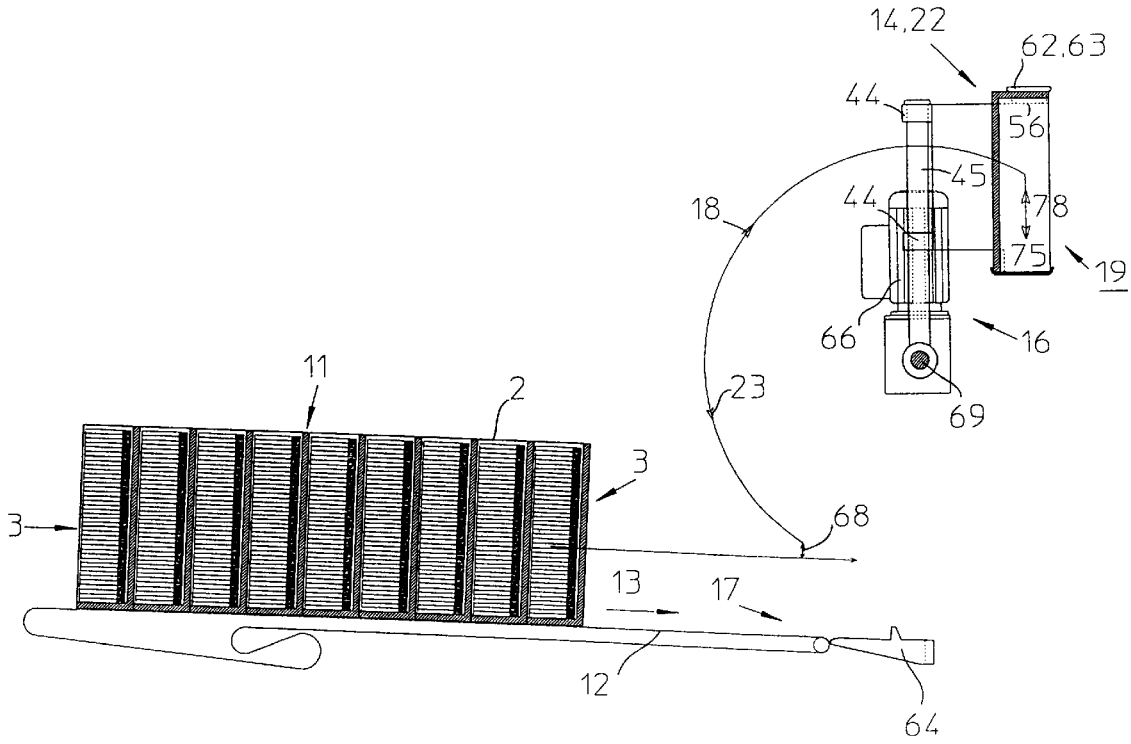

FIG. 7 shows the carriage 14 and the tray 3 therein above the emptying station 19, and FIG. 8 shows the structure of FIG. 7 but with the tray (22) in the carriage 14 subsequent to completion of the dumping operation. Furthermore, the emptied tray 22 which was supported by the member 64 of the lowering unit 24 prior to emptying of the filled tray 3 at the station 19 (as shown in FIG. 7) is assumed to have been lowered to the level of the conveyor 26.

Figure 9:
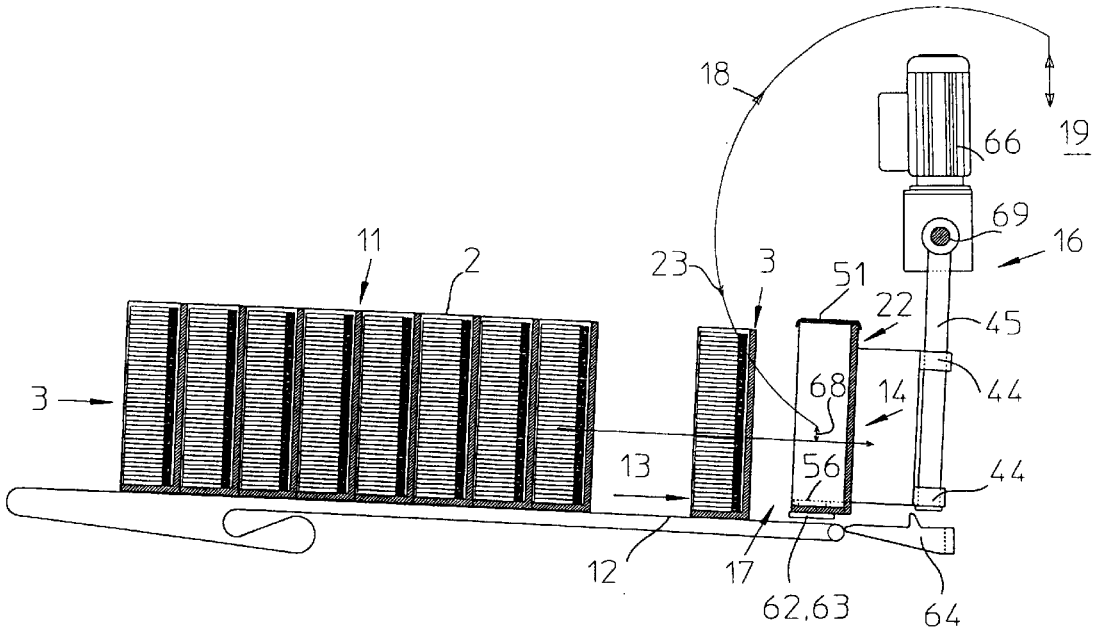
Figure 10:
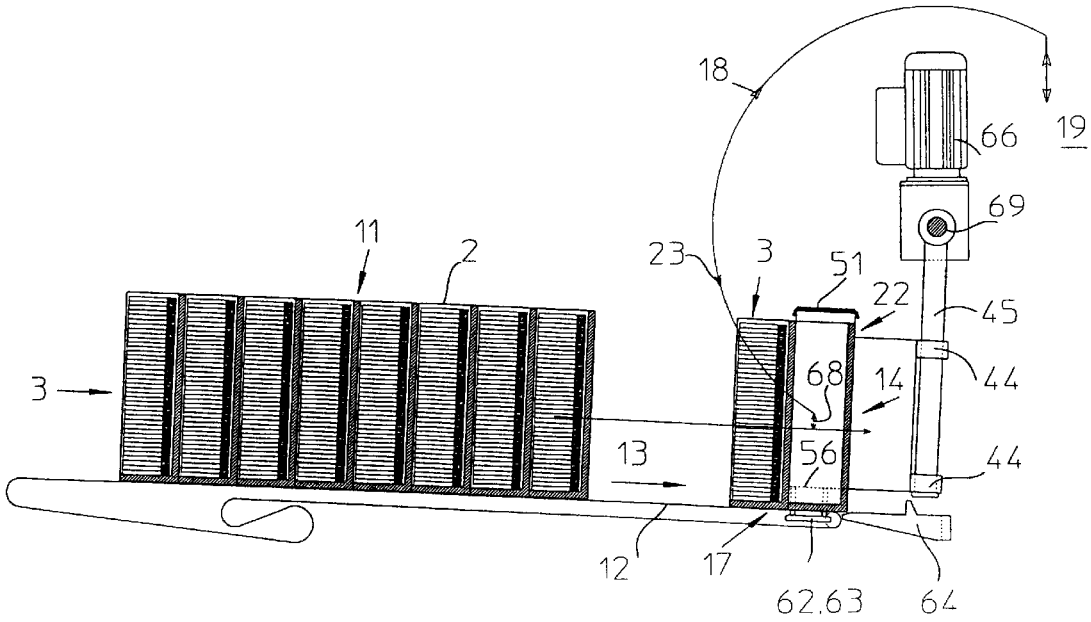

FIG. 9 shows the carriage 14, with a freshly emptied tray 22 therein, back at the location 17, and a filled tray 3 on its way from the source 11 toward the open front side of the carriage. In FIG. 10, the filled tray 3 is nearer to the carriage 14, and the latter is disconnected from the emptied tray therein so that such emptied tray is ready to be expelled from the carriage in response to further rightward movement of the nearest filled tray 3 (see FIG. 11 which shows that about one-half of the emptied tray 22 rests of the member 64 of the lowering unit 24).

Figure 12:
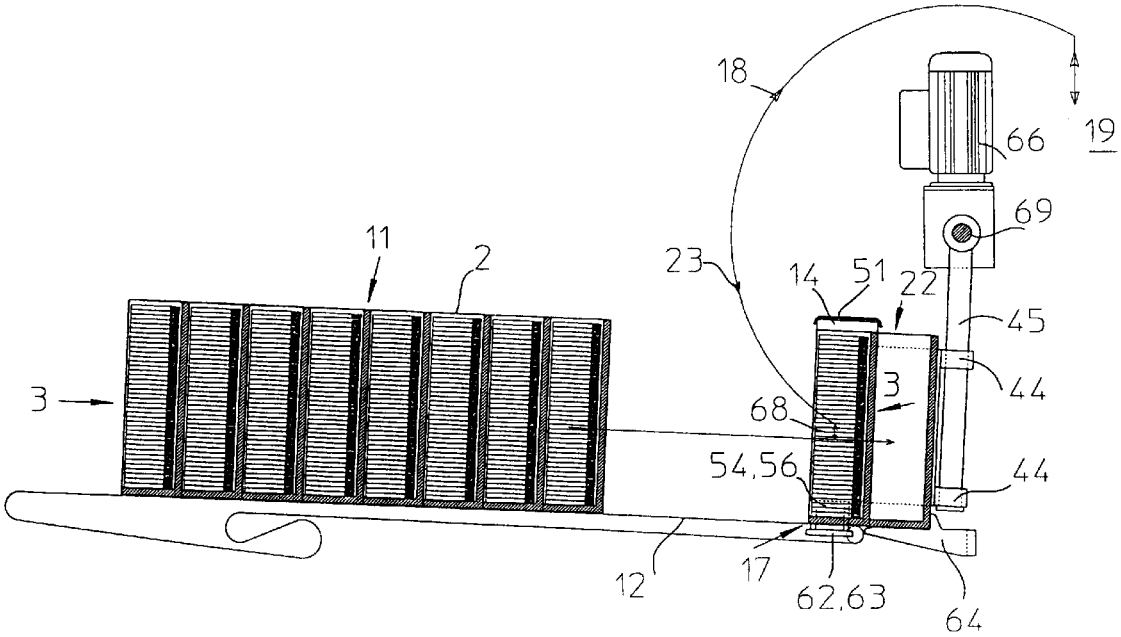

FIG. 12 shows the foremost filled tray 3 fully confined in the carriage 14 and the expelled emptied tray 22 on the member 64.

FIGS. 13 through 16 illustrate certain details of a modified apparatus. All such parts of the apparatus of FIGS. 13–16 which are identical with or plainly analogous to the corresponding parts of the apparatus 1 are denoted by similar reference characters. A difference between the two apparatus is that the means for advancing filled trays 3 from the source 11 of FIGS. 13–16 into the carriage 14 at the location 17 does not include the belts of the conveyor 12 but rather a linear actuator 82 which is designed to actually expel an emptied tray 22 from the carriage 14 in response to introduction of a fresh tray 3. An advantage of such advancing means is that it takes even less time to advance (such as propel) at least one filled tray 3 into the carriage at the, location 17 than by resorting to the conveyor 12 shown in FIGS. 1 through 12. The arrangement is or can be such that the conveyor 12 of FIGS. 13–16 starts the advancement of at least one filled tray 3 from the source 11 toward the location 17, and such advancement is completed (at a higher speed) by the actuator 82. All in all, the apparatus embodying the structure of FIGS. 13–16 can deliver filled trays 3 (either singly or in groups of two or more) at a frequency higher than that achievable with the apparatus 1.

The transporting unit 16, the magazine (not shown) at the emptying station 19, the lowering unit including the tray intercepting member 64, and the storage facility (not shown) of the apparatus embodying the structure of FIGS. 13–16 are (or can be) identical with or similar or analogous to the corresponding parts of the apparatus 1.

Figure 13:
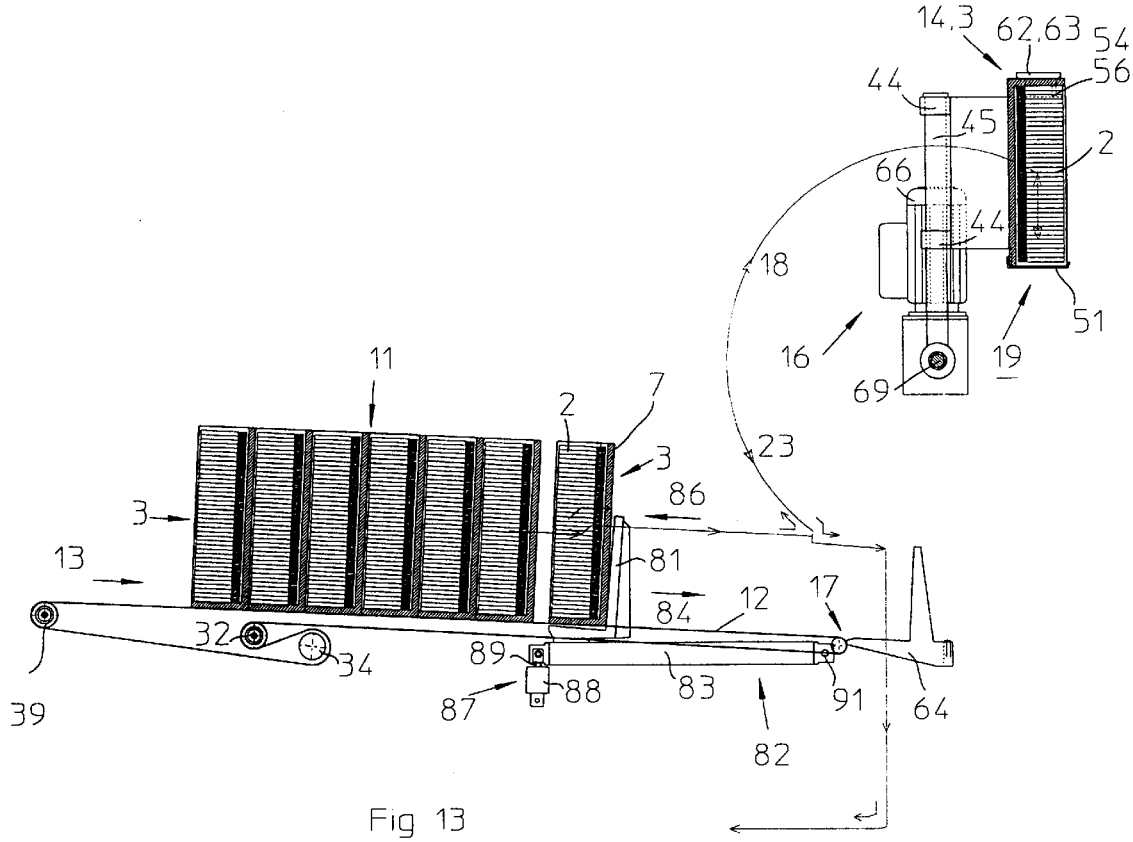
FIG. 13 is a side elevational view similar to that of any one of FIGS. 4 to 12 but showing a portion of a modified apparatus.

FIG. 13 shows the carriage 14 and a filled tray 3 therein at the second location (i.e., at a level above that of the location 17), in inverted position and adjacent the emptying staton 19. The actuator 82 comprises a receptacle or vehicle 81 (hereinafter called vehicle) which has received the foremost filled tray 3 of the supply of such trays on the conveyor 12. The actuator 82 can comprise a fluid-operated (such as pneumatic) cylinder 83 which does not embody or cooperate with a discrete outwardly extending piston rod. Instead, the vehicle 81 is operatively connected directly with the piston in the cylinder 83 or with an internal piston rod in the cylinder. The connection between the piston and/or piston rod on the one hand, and the vehicle 81 on the other hand, can include a mechanical coupling member extending through an axially parallel at least substantially sealed slot of the cylinder 83. Alternatively, one can resort to a contactless (e.g., magnetic) coupling between the piston or piston rod in the cylinder 83 and the vehicle 81. The arrows 84 and 86 respectively indicate the directions of movements of the vehicle 81 toward and away from the location 17.

It is possible to replace the illustrated linear actuator 82 with another suitable means for rapidly advancing one or more filled trays 3 from the source 11 or another suitable source toward and into a carriage 14 at the location 17. For example, one can resort to a rack-and-pinion drive, to a conveyor employing one or more toothed belts or chains, or to any other suitable combined carriage filling and tray expelling means.

The apparatus of FIGS. 13–16, and more specifically its linear actuator 82, further comprises means (87) for tilting the vehicle 81 and at least one filled tray 3 therein so that the rear wall of the foremost filled tray comes to rest on an upwardly extending wall of the vehicle 81 under the action of gravity. The illustrated tilting means 87 comprises a fluid-operated (e.g., pneumatic) double-acting cylinder 88 containing a piston (not shown) for a piston rod 89 articulately connected with that end portion of the cylinder 83 which is remote from the tray lowering unit including the intercepting member 64. The other end portion of the cylinder 83 is pivotable about the horizontal axis of a shaft 91 shown adjacent the location 17.

Figure 14:
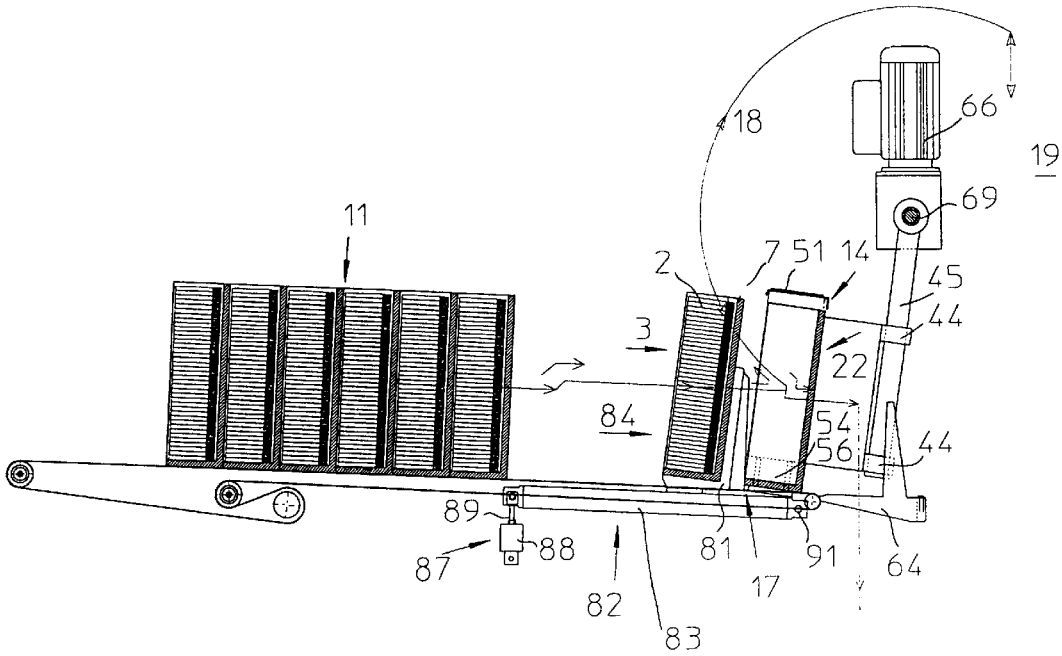
FIGS. 14 to 16 are views similar to that of FIG. 13 but showing the carriage of the modified apparatus in different positions.

FIG. 13 shows the vehicle 81 prior to tilting of the cylinder 83 about the axis of the shaft 91 in a clockwise direction. FIG. 14 shows the cylinder 83 in an orientation subsequent to clockwise tilting by the tilting means 87. As already mentioned hereinbefore, such tilting of the cylinder 83 (and hence of the vehicle 81 which is movable longitudinally of the cylinder 83 but is compelled to share the pivotal movements of such cylinder about the axis of the shaft 91) causes the rear wall 7 of the foremost filled tray 3 to lean against the upwardly extending wall of the vehicle 81. Such tilting of the filled tray 3 with the vehicle 81 greatly reduces the likelihood of any (or any noticeable) shifting of cigarettes 2 in the filled tray in response to abrupt acceleration of the vehicle in the direction of the arrow 84, i.e., from the source 11 toward the carriage 14 at the location 17, as well as in response to abrupt deceleration of the vehicle. Abrupt deceleration is likely to take place during the last stage of advancement of the vehicle 81 into the carriage 14 in order to introduce at least one filled tray 3 into the carriage and to simultaneously expel the emptied tray(s) 22 from the carriage onto the intercepting member 64 of the tray lowering unit.

Figure 15:
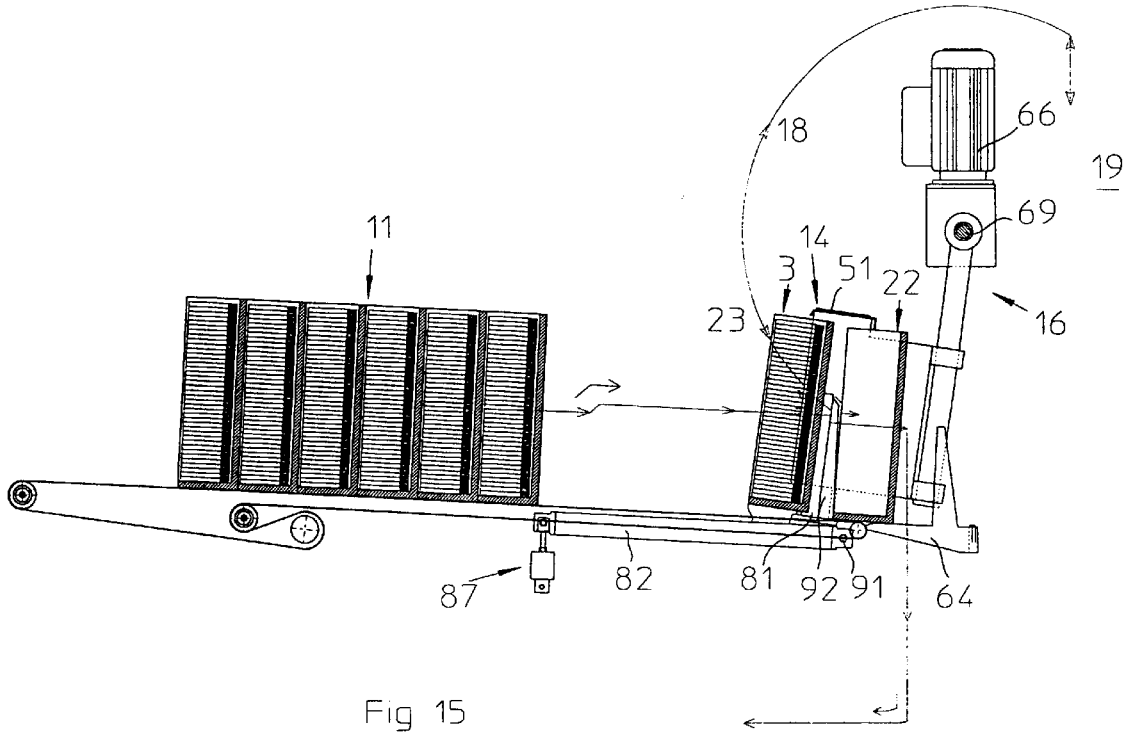

FIG. 14 shows the already tilted vehicle 81, and the filled tray 3 therein, in intermediate positions in which the vehicle is about to begin with the expelling step. In the position of FIG. 15, the vehicle 81 has completed the expulsion of approximately one-half of the emptied tray 22 from the carriage 14 and onto the intercepting member 64. The advancement of the vehicle 81 from the position of FIG. 14 to that shown in FIG. 15 is effected, preferably at a high or very high speed, by the linear actuator 82. The vehicle 81 has an extension 92 (FIGS. 13–16 show a wedge-shaped extension) which actually contacts the emptied tray 22 in the carriage 14 and expels such tray onto the intercepting member 64.

Figure 16:
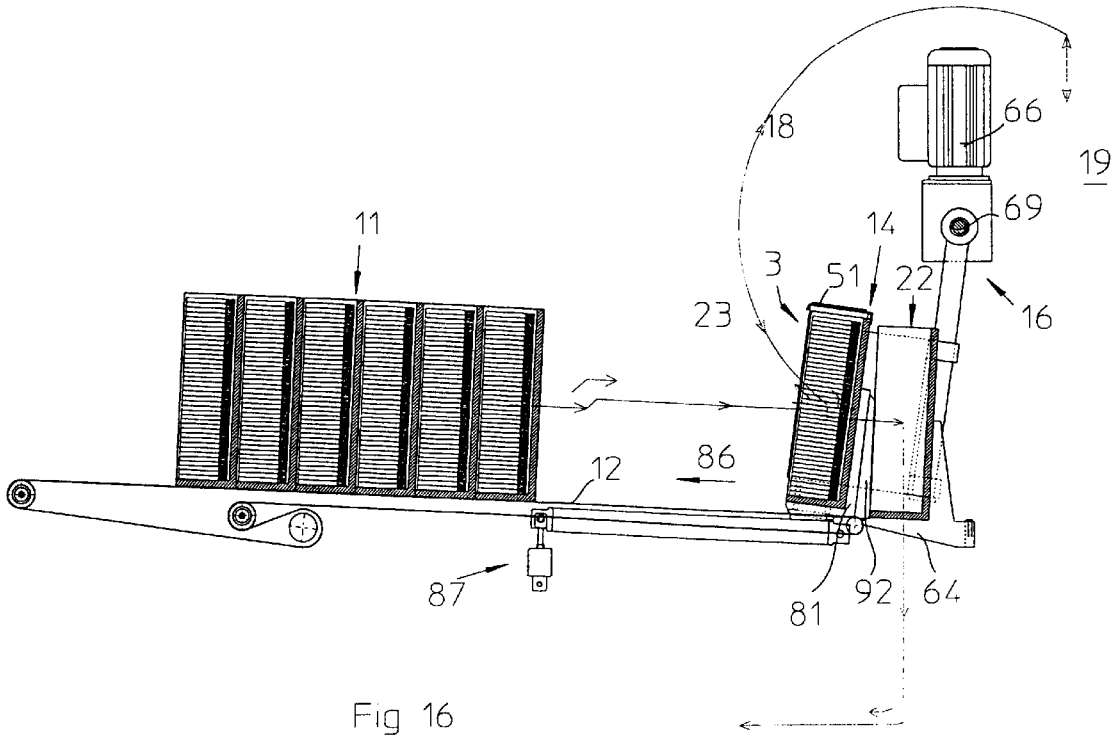

FIG. 16 illustrates the emptied tray 22 in a fully expelled position in which such tray rests solely on the intercepting member 64. The carriage 14 confines a filled tray 3 and is ready to be caused to leave the location 17, to move along the arcuate path in the direction indicated by the arrow 18, and on to the tray evacuating or emptying station 19. Once the pivoting of the carriage 14 and of at least one filled tray 3 therein in the direction of the arrow 18 is completed to an extent which is needed to lift the carriage to a level above the vehicle 81, the actuator 82 is caused to move the vehicle in the direction of the arrow 86 back to a starting or retracted position which is shown in FIG. 13. The vehicle 81 is then disposed at a maximum distance from the location 17, i.e., rapid advancement of the foremost filled tray 3 from the position of FIG. 13 to the position of FIG. 16 results in Appreciable savings in time, especially if the transport of successive filled trays 3 from the source 11 to the location 17 must be carried out at a high frequency. This enables the apparatus of FIGS. 13–16 to meet the requirements of at least one high-speed processing (such as cigarette packing) machine.

The tilting device 87 lower s the left-hand end portion of the cylinder 83 of the actuator 82 not later than upon completion of return movement of the vehicle 81 to the retracted or starting position of FIG. 13.

In all other respects, the construction and the mode of operation of the apparatus embodying the structure shown in FIGS. 13–16 are or can be identical with the construction and mode of operation of the apparatus 1.

An important advantage of the improved method and apparatus is that the frequency at which the carriage 14 can transport successive individual filled trays 3, or successive groups of two or more filled trays, from the source 11 of filled trays 3 to the emptying or evacuating station 19 can be increased without necessitating the provision of any (or any bulky, complex and expensive) additional equipment. The reason is that the emptied trays 22 which are returned to the location 17 are expelled from the carriage 14 (either directly as shown in FIGS. 1–12 or indirectly as shown in FIGS. 13–16) by the next-following individual filled trays or groups of next-following filled trays. Moreover, it has been found that such mode of introducing filled trays 3 into the carriage 14 does not affect the quality and/or the mutual positions of cigarettes 2 in the filled trays which are on their way toward; into and with the carriage.

Another important advantage of the improved method and apparatus is that the customary cuboid (i.e., rectangular parallelepiped) trays 3, 22 are suited for direct or indirect expulsion of one or more emptied trays (22) from the carriage 14 by resorting to one or more filled trays. Thus, the improved apparatus can employ trays which are utilized in conventional tray filling, transporting and emptying apparatus. As a rule, the rear wall 7 of a tray 3 or 22 which can be utilized in the apparatus of the present invention is the largest wall of the tray and can have a square outline.

The aforedescribed construction of the magazine 21, with the mobile walls 72 arranged to move relative to the stationary part 73 in order to enhance the reliability of admission of the contents of a filled tray 3 at the station 19 into such magazine, is believed to constitute an innovation worthy of patent protection jointly with as well as independently of other features of the improved apparatus. The magazine 21 and the manner in which the carriage 14 can cooperate with the mobile parts of such magazine render it possible to evacuate or empty the contents (2) of a filled tray 3 in a time-saving manner to thus ensure that a high-speed processing machine which receives commodities from the magazine can be operated at maximum capacity for short or long periods of time. Since the inverted tray 3 at the station 19 can begin to dump its contents into the magazine 21 only when the cover 51 of the inverted carriage 14 is closely or immediately adjacent the topmost layer of cigarettes 2 in the magazine, actual dumping necessitates the descent of a mass flow of cigarettes through a short or very short distance so that the orientation of descending cigarettes does not change at all or that any misorientation is eliminated as soon as the cigarettes come to rest on the layer of cigarettes beneath them. It has been found that the likelihood of pronounced misalignment of cigarettes in the magazine 21 is remote, even when the inverted carriage 14 and the filled or still partially filled tray therein begin to rise prior to return movement from the station 19 to the location 17. This reduces the number of stoppages which are necessary in the improved apparatus well below the number of stoppages necessary in conventional apparatus in order to remove or to change the positions of misaligned cigarettes in the magazine of a cigarette packing or other processing machine.

The features 81, 82, 83 of the apparatus of FIGS. 13–16 also constitute innovations which are believed to merit patent protection in conjunction with as well as independently of other features of such apparatus.

It is often advisable or necessary to install the processing machine or machines (such as one or more cigarette packing machines) at a distance from the emptying station 19 of the improved apparatus. Under such circumstances, the magazine 21 (or an equivalent magazine) can be utilized for temporary accumulation and storage of commodities which are transported to the processing machine(s) by discrete apparatus. As already mentioned above, such discrete apparatus can be designed for the conveying of one or more mass flows of cigarettes or analogous rod-shaped smokers' products. Reference may be had again to U.S. Pat. No. 5,472,078.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating containers for cigarettes or the like and, therefore, such adaptations should and are intended to be comprehended within the meaning and range of equivalence of the appended claims.

What is claimed is:

1. A method of manipulating successive filled and emptied containers by a mobile carriage between a source of filled containers and an emptying station, comprising the steps of:

conveying the carriage with an emptied container therein from the emptying station to the source;

advancing a filled container from the source into the carriage to thus directly and at least partially expel the emptied container from the carriage;

transporting the carriage and the filled container therein from the source to the emptying station;

evacuating the contents of the filled container in the carriage at the emptying station to thus convert the filled container into an emptied container; and repeating the conveying, advancing, transporting and evacuating steps.

2. The method of claim 1, wherein said conveying step includes moving the carriage with an emptied container therein from the emptying station, along a predetermined path and to the source, said transporting step including moving the carriage and the filled container therein from the source, along said predetermined path and to the emptying station.

3. The method of claim 1, further comprising the step of releasably securing the container in the carriage to the carriage in the course of at least one of said conveying, transporting and evacuating steps.

4. The method of claim 1, wherein said advancing step includes positively driving a filled container from the source into the carriage.

5. The method of claim 1, further comprising the step of lowering the expelled emptied container to a level beneath the source.

6. The method of claim 5, further comprising the step of moving the lowered emptied container along an at least substantially horizontal path.

7. The method of claim 1, wherein the containers are trays arranged for temporary storage and transport of rod-shaped articles of the tobacco processing industry, and further comprising the steps of filling a succession of empty trays with rod-shaped articles and delivering the thus filled trays to the source.

8. The method of claim 7, wherein said evacuating step includes admitting rod-shaped articles from the filled container at the emptying station into a packing machine for rod-shaped articles of the tobacco processing industry.

9. The method of claim 1, wherein said transporting step includes turning the carriage and the filled container therein upside down during transport from the source to the emptying station.

10. The method of claim 9, wherein said evacuating step includes emptying the filled container at the emptying station by gravity flow of its contents into a magazine.

11. The method of claim 1, wherein said transporting step includes moving the carriage and the filled container therein from the source to the emptying station along an at least partially arcuate path.

12. The method of claim 11 of manipulating successive filled and emptied containers for flowable commodities, further comprising the step of maintaining a descending supply of commodities at the emptying station, said evacuating step including lowering the filled container at the emptying station toward the descending supply of commodities and thereupon releasing the commodities for gravitational descent from the filled container onto the descending supply of commodities, said conveying step including raising the carriage and the emptied container therein above and away from the descending supply of commodities at the emptying station and thereupon moving the carriage and the emptied container therein from the emptying station to the source.

13. The method of claim 12, wherein the transporting step further includes inverting the carriage and the filled container therein upside down so that the commodities in the filled container come to rest on a retractable cover of the carriage at the emptying station, said releasing step including retracting the cover of the carriage.

14. The method of claim 13, further comprising the steps of monitoring the position of the carriage at the emptying station, generating signals denoting the position of the carriage at the emptying station, and utilizing the signals to initiate retraction of the cover in a predetermined position of the carriage relative to the emptying station.

15. Apparatus for manipulating successive filled and emptied containers, comprising:

a source of filled containers;

an emptying unit including means for receiving the contents of filled containers, a carriage for filled and emptied containers, and transporting means for moving said carriage with at least one filled container therein from a first location at said source to a second location at said receiving means and for moving said carriage with at least one emptied container from said second location back to said first location; and means for introducing filled containers from the source into the carriage at said first location to an extent such that the emptied at least one container is directly and at least partially expelled from the carriage as a result of introduction of at least one filled container.

16. The apparatus of claim 15, wherein said transporting means includes means for moving said carriage and its contents back and forth along an at least partially arcuate path having a first end at said source and a second end at said receiving means.

17. The apparatus of claim 15, further comprising means for releasably securing containers to said carriage while the carriage is away from said first location.

18. The apparatus of claim 17, wherein said securing means includes means for temporarily locking containers to said carriage during movement of the carriage between a first level of said first location and a different second level of said second location.

19. The apparatus of claim 15, wherein said introducing means comprises a transfer unit having means for advancing filled containers from said source into said carriage at said first location.

20. The apparatus of claim 19, wherein said advancing means includes means for moving filled containers along an at least partially horizontal path.

21. The apparatus of claim 19, wherein said advancing means includes means for moving filled containers along an at least substantially horizontal path.

22. The apparatus of claim 15, wherein said carriage includes a cover movable between an operative position overlying and an inoperative position offset from a filled container in said carriage, said transporting means including means for turning said carriage and at least one filled container therein upside down during movement from said first location to said second location and for thus causing the contents of a filled container to come to rest on said cover while said cover dwells in said operative position thereof.

23. The apparatus of claim 22, wherein said emptying unit further comprises means for moving said cover to said inoperative position upon arrival of said carriage at said second location.

24. The apparatus of claim 15, wherein said source comprises means for filling emptied containers with rod-shaped articles of the tobacco processing industry.

25. The apparatus of claim 24, wherein said receiving means is associated with a machine for processing rod-shaped articles of the tobacco processing industry.

26. The apparatus of claim 25, wherein said processing machine includes a packing machine.

27. The apparatus of claim 15, further comprising means for intercepting emptied containers upon expulsion from said carriage.

28. The apparatus of claim 27, wherein said intercepting means comprises means for lowering emptied containers from a first level of said first location to a second level below said first location.

29. The apparatus of claim 28, further comprising a storage facility for emptied containers supplied by said lowering means.

30. The apparatus of claim 29, wherein said storage facility comprises an at least substantially horizontal conveyor.

31. A method of manipulating successive filled and emptied containers by a mobile carriage between a source of filled containers and an emptying station, comprising the steps of:

conveying the carriage with an emptied container therein from the emptying station to the source;

advancing a filled container with a vehicle from the source into the carriage to directly and at least partially expel the emptied container from the carriage with said vehicle;

transporting the carriage and the filled container therein from the source to the emptying station;

evacuating the contents of the filled container in the carriage at the emptying station to thus convert the filled container into an emptied container; and repeating the conveying, advancing, transporting and evacuating steps.

32. The method of claim 31, wherein said conveying step includes moving the carriage with an emptied container therein from the emptying station, along a predetermined path and to the source, said transporting step including moving the carriage and the filled container therein from the source, along said predetermined path and to the emptying station.

33. The method of claim 31, further comprising the step of releasably securing the container in the carriage to the carriage in the course of at least one of said conveying, transporting and evacuating steps.

34. The method of claim 31, further comprising the step of lowering the expelled emptied container to a level beneath the source.

35. The method of claim 34, further comprising the step of moving the lowered emptied container along an at least substantially horizontal path.

36. The method of claim 31, wherein said advancing step includes positively driving a filled container from the source into the carriage.

37. The method of claim 31, wherein the containers are trays arranged for temporary storage and transport of rod-shaped articles of the tobacco processing industry, and further comprising the steps of filling a succession of empty trays with rod-shaped articles and delivering the thus filled trays to the source.

38. The method of claim 37, wherein said evacuating step includes admitting rod-shaped articles from the filled container at the emptying station into a packing machine for rod-shaped articles of the tobacco processing industry.

39. The method of claim 31, wherein said transporting step includes turning the carriage and the filled container therein upside down during transport from the source to the emptying station.

40. The method of claim 39, wherein said evacuating step includes emptying the filled container at the emptying station by gravity flow of its contents into a magazine.

41. The method of claim 31, wherein said transporting step includes moving the carriage and the filled container therein from the source to the emptying station along an at least partially arcuate path.

42. The method of claim 41 of manipulating successive filled and emptied containers for flowable commodities, further comprising the step of maintaining a descending supply of commodities at the emptying station, said evacuating step including lowering the filled container at the emptying station toward the descending supply of commodities and thereupon releasing the commodities for gravitational descent from the filled container onto the descending supply of commodities, said conveying step including raising the carriage and the emptied container therein above and away from the descending supply of commodities at the emptying station and thereupon moving the carriage and the emptied container therein from the emptying station to the source.

43. The method of claim 42, wherein the transporting step further includes inverting the carriage and the filled container therein upside down so that the commodities in the filled container come to rest on a retractable cover of the carriage at the emptying station, said releasing step including retracting the cover of the carriage.

44. The method of claim 43, further comprising the steps of monitoring the position of the carriage at the emptying station, generating signals denoting the position of the carriage at the emptying station, and utilizing the signals to initiate retraction of the cover in a predetermined position of the carriage relative to the emptying station.

45. Apparatus for manipulating successive filled and emptied containers, comprising:

a source of filled containers;

an emptying unit including means for receiving the contents of filled containers, a carriage for filled and emptied containers, and transporting means for moving said carriage with at least one filled container therein from a first location at said source to a second location at said receiving means and for moving said carriage with at least one emptied container from said second location back to said first location; and means for introducing filled containers from the source into the carriage at said first location to an extent such that the emptied at least one container is directly and at least partially expelled from the carriage by the introducing means.

46. The apparatus of claim 45, wherein said transporting means includes means for moving said carriage and its contents back and forth along an at least partially arcuate path having a first end at said source and a second end at said receiving means.

47. The apparatus of claim 45, further comprising means for releasably securing containers to said carriage while the carriage is away from said first location.

48. The apparatus of claim 47, wherein said securing means includes means for temporarily locking containers to said carriage during movement of the carriage between a first level of said first location and a different second level of said second location.

49. The apparatus of claim 45, wherein said carriage includes a cover movable between an operative position overlying and an inoperative position offset from a filled container in said carriage, said transporting means including means for turning said carriage and at least one filled container therein upside down during movement from said first location to said second location and for thus causing the contents of a filled container to come to rest on said cover while said cover dwells in said operative position thereof.

50. The apparatus of claim 49, wherein said emptying unit further comprises means for moving said cover to said inoperative position upon arrival of said carriage at said second location.

51. The apparatus of claim 45, wherein said introducing means comprises a transfer unit having means for advancing filled containers from said source into said carriage at said first location.

52. The apparatus of claim 51, wherein said advancing means includes means for moving filled containers along an at least partially horizontal path.

53. The apparatus of claim 51, wherein said advancing means includes means for moving filled containers along an at least substantially horizontal path.

54. The apparatus of claim 45, wherein said source comprises means for filling emptied containers with rod shaped articles of the tobacco processing industry.

55. The apparatus of claim 54, wherein said receiving means is associated with a machine for processing rod-shaped articles of the tobacco processing industry.

56. The apparatus of claim 55, wherein said processing machine includes a packing machine.

57. The apparatus of claim 45, further comprising means for intercepting emptied containers upon expulsion from said carriage.

58. The apparatus of claim 57, wherein said intercepting means comprises means for lowering emptied containers from a first level of said first location to a second level below said first location.

59. The apparatus of claim 58, further comprising a storage facility for emptied containers supplied by said lowering means.

60. The apparatus of claim 59, wherein said storage facility comprises an at least substantially horizontal conveyor.

61. Apparatus for manipulating successive filled and emptied containers, comprising:

a source of filled containers;

an emptying unit including means for receiving the contents of filled containers, a carriage for filled and emptied containers, and transporting means for moving said carriage with at least one filled container therein from a first location at said source to a second location at said receiving means and for moving said carriage with at least one emptied container from said second location back to said first location, said means for receiving including at least one wall movable between a raised and a lowered position; and means for introducing filled containers from the source into the carriage at said first location to an extent such that the emptied at least one container is at least indirectly and at least partially expelled from the carriage as a result of introduction of at least one filled container, wherein said carriage includes a cover movable between an operative position overlying and an inoperative position offset from a filled container in said carriage, said transporting means including means for turning said carriage and at least one filled container therein upside down during movement from said first location to said second location and for thus causing the contents of a filled container to come to rest on said cover while said cover dwells in said operative position thereof, and wherein said emptying unit further comprises means for moving said cover to said inoperative position upon arrival of said carriage at said second location.

62. The apparatus of claim 61 wherein said means for receiving comprises a magazine for the contents of emptied containers, said magazine having an open top and said at least one wall being adjacent said open top.

63. The apparatus of claim 62, wherein said carriage comes to rest upon the raised wall of said receiving means when said carriage arrives at said second location, and further comprising means for lowering said at least one wall with the carriage thereon and means for setting said lowering means in motion to a level at which said cover is located at a predetermined distance from and above the contents of said magazine.

64. The apparatus of claim 63, wherein said means for moving said cover is arranged to move the cover to said inoperative position upon completed lowering of said at least one wall to said level at which said cover is located at said predetermined distance from and above the contents of said magazine.

65. Apparatus for manipulating successive filled and emptied containers, comprising:

a source of filled containers;

an emptying unit including means for receiving the contents of filled containers, a carriage for filled and emptied containers, and transporting means for moving said carriage with at least one filled container therein from a first location at said source to a second location at said receiving means and for moving said carriage with at least one emptied container from said second location back to said first location; and means for introducing filled containers from the source into the carriage at said first location to an extent such that the emptied at least one container is at least indirectly and at least partially expelled from the carriage as a result of introduction of at least one filled container, said introducing means comprising a transfer unit having means for advancing filled containers from said source into said carriage at said first location, said advancing means comprising a vehicle for filled containers and means for moving said vehicle, with at least one filled container therein, from the source to the carriage at said first location.

66. The apparatus of claim 65, wherein said vehicle constitutes a means for directly contacting and at least partially expelling emptied containers from the carriage at said first location.

67. The apparatus of claim 65, wherein said vehicle has a substantially upright wall and said advancing means further comprises means for tilting said vehicle so that a filled receptacle in the tilted vehicle abuts said wall under the action of gravity.

68. The apparatus of claim 67, further comprising means for actuating said tilting means during a predetermined stage of dwell of said carriage at said first location.

69. Apparatus for manipulating successive filled and emptied containers, comprising:

a source of filled containers;

an emptying unit including means for receiving the contents of filled containers, a carriage for filled and emptied containers, and transporting means for moving said carriage with at least one filled container therein from a first location at said source to a second location at said receiving means and for moving said carriage with at least one emptied container from said second location back to said first location; and means for introducing filled containers from the source into the carriage at said first location to an extent such, that the emptied at least one container is at least indirectly and at least partially expelled from the carriage as a result of introduction of at least one filled container, said introducing means comprising a transfer unit having means for advancing filled containers from said source into said carriage at said first location and at least one linear actuator.

70. The apparatus of claim 69, wherein said at least one linear actuator comprises a piston rod-free fluid-operated motor.

71. The apparatus of claim 70, wherein said motor is a pneumatically operated motor.

72. A method of manipulating successive filled and emptied containers by a mobile carriage between a source of filled containers and an emptying station, comprising the steps of:

conveying the carriage with an emptied container therein from the emptying station to the source;

advancing a filled container from the source into the carriage to thus at least indirectly and at least partially expel the emptied container from the carriage, said advancing step including moving a filled container from the source into the carriage to an extent which is necessary to expel the entire emptied container from the carriage;

transporting the carriage and the filled container therein from the source to the emptying station;

evacuating the contents of the filled container in the carriage at the emptying station to thus convert the filled container into an emptied container; and repeating the conveying, advancing, transporting and evacuating steps.

73. A method of manipulating successive filled and emptied containers by a mobile carriage between a source of filled containers and an emptying station, comprising the steps of:

conveying the carriage with an emptied container therein from the emptying station to the source;

advancing a filled container from the source into the carriage to thus at least indirectly and at least partially expel the emptied container from the carriage, said advancing step including positively driving a filled container from the source into the carriage and tilting the carriage not later than upon completion of the conveying step;

transporting the carriage and the filled container therein from the source to the emptying station;

evacuating the contents of the filled container in the carriage at the emptying station to thus convert the filled container into an emptied container; and repeating the conveying, advancing, transporting and evacuating steps.

74. A method of manipulating successive filled and emptied containers by a mobile carriage between a source of filled containers and an emptying station, comprising the steps of:

conveying the carriage with an emptied container therein from the emptying station to the source;

advancing a filled container from the source into the carriage to thus at least indirectly and at least partially expel the emptied container from the carriage, said advancing step including utilizing the filled container to fully expel the emptied container from the carriage;

transporting the carriage and the filled container therein from the source to the emptying station;

evacuating the contents of the filled container in the carriage at the emptying station to thus convert the filled container into an emptied container; and repeating the conveying, advancing, transporting and evacuating steps, said advancing step including utilizing the filled container to fully expel the emptied container from the carriage.

* * * * *